US009010540B2

(12) United States Patent
Smith et al.

(10) Patent No.: US 9,010,540 B2
(45) Date of Patent: Apr. 21, 2015

(54) SANITARY GAPLESS SEPARATOR DISCHARGE

(75) Inventors: Joseph L. Smith, Cincinnati, OH (US); Donald J. Canavan, Florence, KY (US)

(73) Assignee: M-I L.L.C., Houston, TX (US)

( * ) Notice: Subject to any disclaimer, the term of this patent is extended or adjusted under 35 U.S.C. 154(b) by 454 days.

(21) Appl. No.: 13/266,145

(22) PCT Filed: May 13, 2010

(86) PCT No.: PCT/US2010/034715

§ 371 (c)(1), (2), (4) Date: Oct. 25, 2011

(87) PCT Pub. No.: WO2010/132667

PCT Pub. Date: Nov. 18, 2010

(65) Prior Publication Data

US 2012/0043262 A1 Feb. 23, 2012

Related U.S. Application Data

(60) Provisional application No. 61/177,779, filed on May 13, 2009.

(51) Int. Cl.

| | |
|---|---|
| ***B07B 1/46*** | (2006.01) |
| ***B07B 1/06*** | (2006.01) |
| ***B07B 13/16*** | (2006.01) |

(52) U.S. Cl.

CPC .. *B07B 1/06* (2013.01); *B07B 13/16* (2013.01)

(58) Field of Classification Search

USPC ..... 209/257, 326, 332, 399, 405

See application file for complete search history.

(56) References Cited

U.S. PATENT DOCUMENTS

| | | | | | |
|---|---|---|---|---|---|
| 2,946,440 | A | * | 7/1960 | Simpson | 209/326 |
| 3,035,700 | A | * | 5/1962 | McCausland | 209/405 |
| 3,399,771 | A | * | 9/1968 | Hryniowski | 209/245 |
| 3,463,727 | A | * | 8/1969 | Fahey | 210/785 |
| 3,483,977 | A | * | 12/1969 | Westfall et al. | 209/403 |
| 4,810,372 | A | * | 3/1989 | Jones | 209/315 |
| 4,929,346 | A | * | 5/1990 | Si-Lin | 209/323 |
| 5,456,365 | A | * | 10/1995 | Janssens et al. | 209/403 |
| 5,951,864 | A | * | 9/1999 | Hazrati et al. | 210/388 |
| 2011/0120920 | A1 | * | 5/2011 | Smith | 209/397 |

FOREIGN PATENT DOCUMENTS

| | | | |
|---|---|---|---|
| JP | 2000-015182 | A | 1/2000 |
| JP | 2000-135474 | A | 5/2000 |
| KR | 10-0268028 | B1 | 10/2000 |

OTHER PUBLICATIONS

International Search Report and Written Opinion for PCT/US2010/034715, Jan. 28, 2011.

* cited by examiner

*Primary Examiner* — Joseph C Rodriguez

(74) *Attorney, Agent, or Firm* — David J Smith

(57) ABSTRACT

A particle size separator includes an upper separator frame, a lower separator frame, a screen disposed between the upper separator frame and the lower separator frame, a large size particle outlet having an inlet disposed below the screen, a small size particle outlet disposed in the lower separator frame and a combined baffle and seal unit disposed in an opening in the screen. The unit has a seal face configured to sealingly engage the inlet of the large size particle outlet. The unit has a baffle configured to constrain movement of particles on an upper surface of the screen into the inlet. The baffle is configured to sealingly engage an interior wall of the upper separator frame.

17 Claims, 8 Drawing Sheets

SANITARY GAPLESS SEPARATOR DISCHARGE

BACKGROUND OF THE INVENTION

1. Field of the Invention

The invention relates generally to the field of solids separation through the use of a gyratory sifter. More specifically, the invention relates to structures for sifter screens and product discharge outlets for such sifters having higher efficiency and product cleanliness.

2. Background Art

Screen type separators are used in a variety of applications for separating solids by size. These applications include separating particles of sugar, flour, sand and various chemical powders. Screen type separators typically include one or more screens. Particles are applied to the screen from above and the screen is caused to move in a selected pattern. Particles larger than the screen openings ("mesh") typically remain above the screen surface for discharge in a respective product outlet (hereinafter "large particle size outlet"), while particles smaller than the mesh will pass through the screen and will be directed to another product outlet ("small particle size product outlet") and/or a further screen for additional size separator. In single screen separator operations there will be two outflows of particulate product, one being the particles held back by the screen and the other containing the particles that pass through the screen. The outflows are typically conducted through respective product outlet conduits. An example of a separator is described in U.S. Pat. No. 5,951,864 issued to Hazrati et al.

In sanitary processing operations or where the particulate product is expensive, it is desirable to have a minimum residue left on the screen after screening operations are completed. Conventional separators such as the one shown in the Hazrati et al '864 patent have a gap between the screen frame and the separator wall that can be as much or more than ¼ inch. The gap area tends to accumulate product, lessening the yield efficiency of the separator and creating sanitation problems in the case of processing animal or human consumables such as food and pharmaceutical products. Structures known in the art for reducing or eliminating the foregoing gap require a ledge inside the product discharge outlet, and such ledge inhibits product discharge.

There continues to be a need for high efficiency, sanitary separators for use with high value and/or human consumable products.

SUMMARY OF THE INVENTION

A particle size separator according to one aspect of the invention includes an upper separator frame, a lower separator frame, a screen disposed between the upper separator frame and the lower separator frame, a large size particle outlet having an inlet disposed below the screen, a small size particle outlet disposed in the lower separator frame and a combined baffle and seal unit disposed in an opening in the screen. The unit has a seal face configured to sealingly engage the inlet of the large size particle outlet. The unit has a baffle configured to constrain movement of particles on an upper surface of the screen into the inlet. The baffle is configured to sealingly engage an interior wall of the upper separator frame.

Other aspects and advantages of the invention will be apparent from the following description and the appended claims.

DETAILED DESCRIPTION

Figure 1:
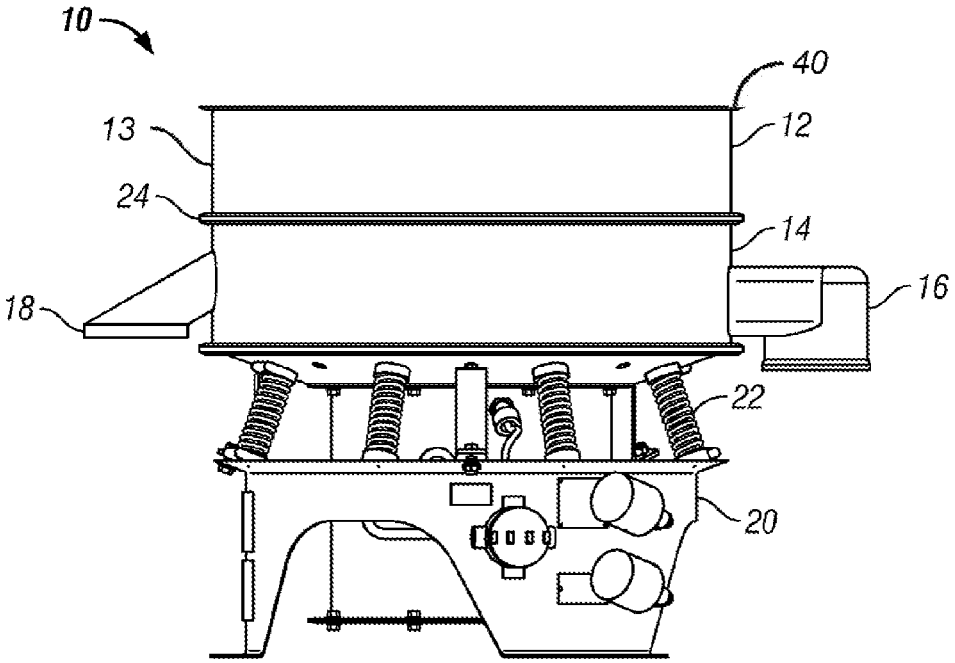
FIG. 1 is a side view of a separator.
Figure 2:
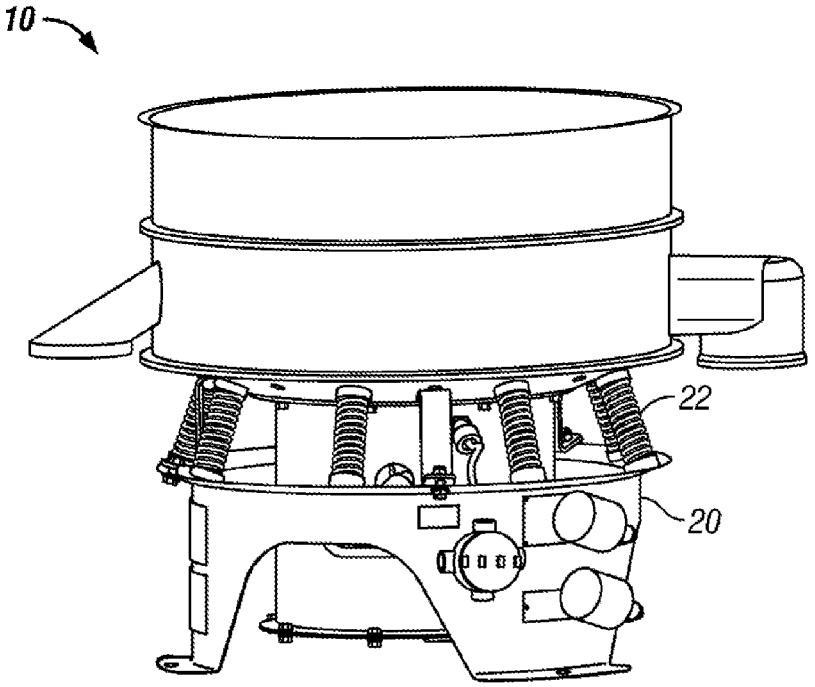
FIG. 2 is an oblique view of the separator shown in FIG. 1.
Figure 3:
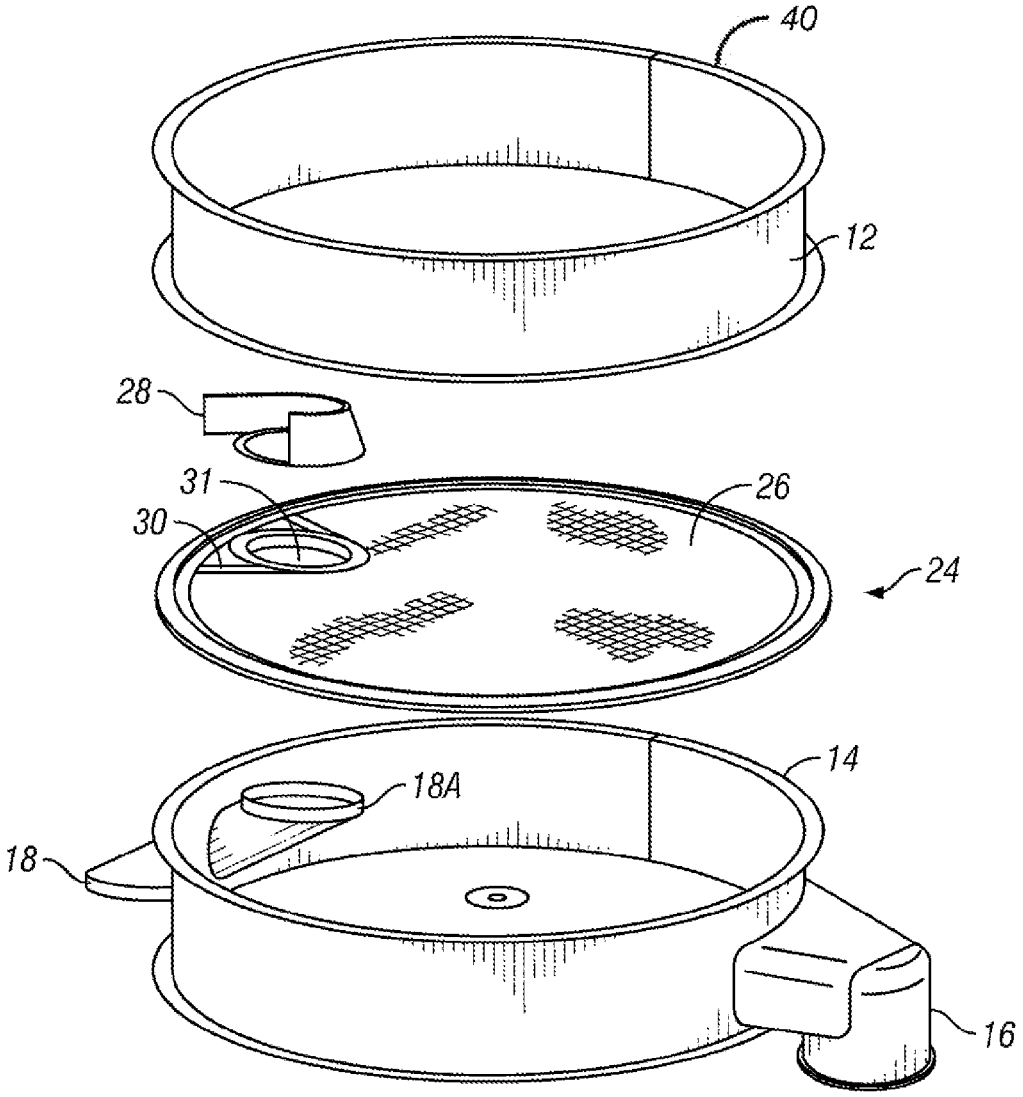
FIG. 3 is an exploded view of the internal components of the separator shown in FIGS. 1 and 2.

An example separator is shown in side view in FIG. 1 and in oblique view in FIG. 2. The separator 10 includes an upper separator frame 12 that can be mounted to a lower separator frame 14. A tension ring 24 including a screen (FIG. 3) mounted therein is disposed between the separator frames 12, 14. The lower separator frame 14 may include a large particle product outlet 18 disposed on one side thereof, and a small particle product outlet 16 on the other side thereof. The position of the product outlets 16, 18 is not a limit on the scope of the present invention. The lower separator frame 14 is mounted using springs 22 to an oscillating base 20. The base 20 includes (none shown separately) a motor and linkages to provide selected motion to the separator frames 12, 14 to cause the product therein to move through the screen (FIG. 3) and the product outlets 16, 18. The present example includes only two separator frames 12, 14, two outlets 16, 18 and one screen (FIG. 3). Those skilled in the art will appreciate that in other examples, additional separator frames, screens and product outlets may be stacked to provide additional product size separation capability. Accordingly, the invention is not limited in scope to only one screen and two separator frames with associated product outlets.

An exploded view of some of the components of the separator is shown in FIG. 3. The upper separator frame 12 appears at the top of the drawing. The tension ring 24 includes a screen 26 having a selected opening size ("mesh") attached thereto. As will be explained below with reference to FIG. 9, the tension ring has a generally L-shaped cross section for mounting between the separator frames 12, 14. The screen 26 includes a large product discharge opening 31 disposed near one circumferential edge thereof. The opening 31 is disposed generally in the center of a product opening plate 30. The product opening plate 30 may be affixed at one edge thereof to the inner circumference of the tension ring 24. A combined baffle and seal unit 28 may be disposed in the opening plate 30. When the frames 12, 14 and tension ring 24 are assembled, the combined baffle and seal unit 28 is sealingly engaged to the upper surface 18A of the large particle size product outlet 18 so that product passing through the opening 31 in the screen 26 is constrained to move into the outlet 18 and not leak into the space below the screen wherein small particle size product is disposed during screening operations. When the frames 12, 14 and tension ring are assembled, the combined baffle and seal unit 28 also sealingly engages the interior wall of the upper separator frame 12 so that product moving along the upper surface of the screen 26 (i.e., the product particles larger than the screen mesh) is constrained to move into the opening 31 rather than past the opening 31 on the outer circumference of the screen 26.

The combined baffle and seal unit 28 may be made from elastomer such as rubber or polyurethane. The material used in any particular example for the unit should have the properties of sealing against a solid surface under compression, should be flexible enough to enable assembly of the unit 28 to the opening plate 30, and where required, meet any requirements for use in sanitary processing facilities. In some examples, the unit 28 may be molded or otherwise formed as a single component.

Figure 4:
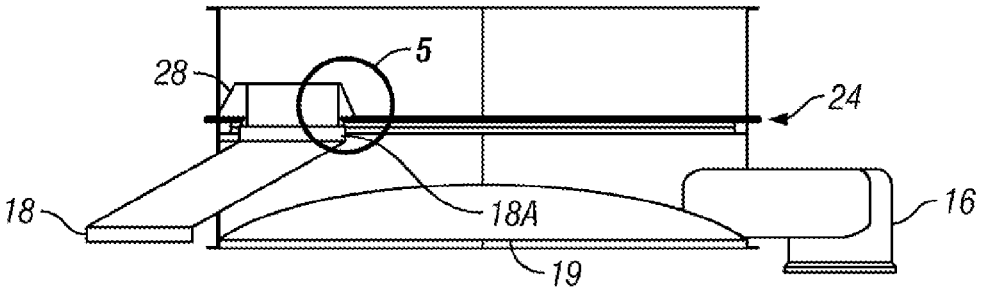
FIG. 4 is a cross sectional view of the components shown in FIG. 3.

The components shown in FIG. 3 are shown in assembled cross section in FIG. 4. FIG. 4 also shows the lower surface 19 of the lower separator frame 14, which may be generally dome-shaped or otherwise shaped to slope away from the center thereof, so that particles travelling through the screen (26 in FIG. 3) will be deflected laterally outwardly toward the small particle size product outlet 16.

Figure 5:
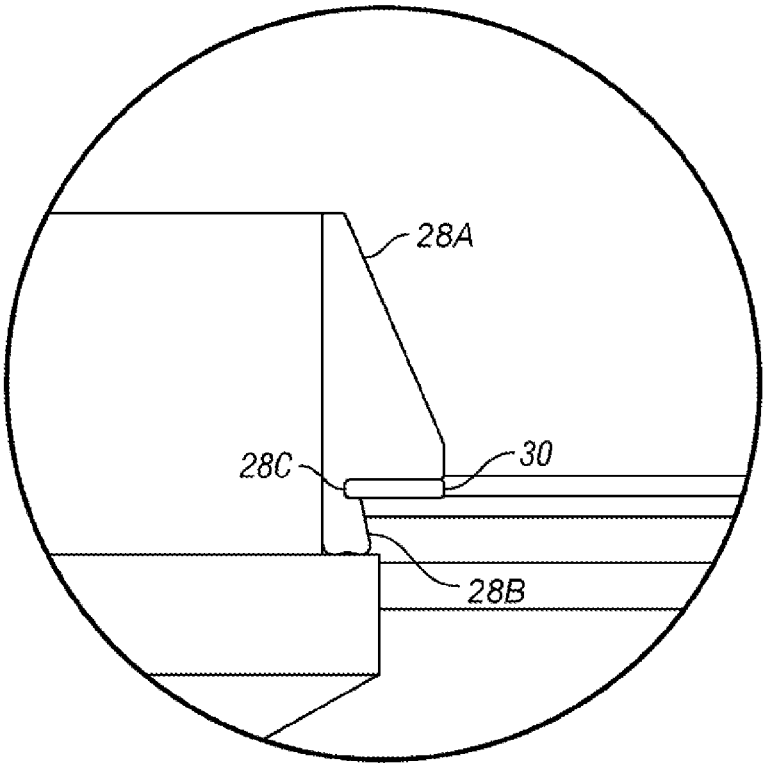
FIG. 5 is a detailed view of a combination seal and baffle shown in FIGS. 3 and 4.

FIG. 5 shows a more detailed view of the combined baffle and seal unit 26. The unit 26 may include a baffle 28A on the portion thereof that extends above the opening plate 30. A channel 28C or similar reduced diameter feature may be circularly shaped, and may sealingly engage the interior surface of the opening in the plate 30. A lower seal flange 28B may extend below the channel 28C to sealingly engage the upper surface (18A in FIG. 3) of the large particle size product outlet (18 in FIG. 3).

Figure 6:
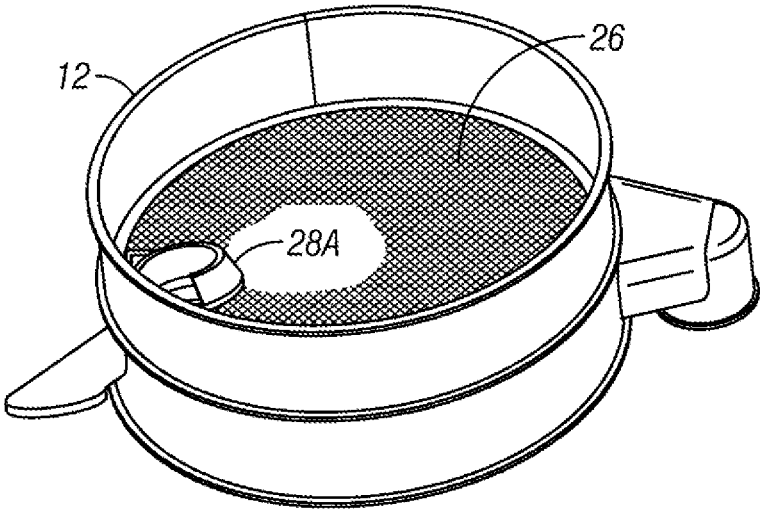
FIG. 6 is an oblique view of the components shown in FIG. 4.
Figure 7:
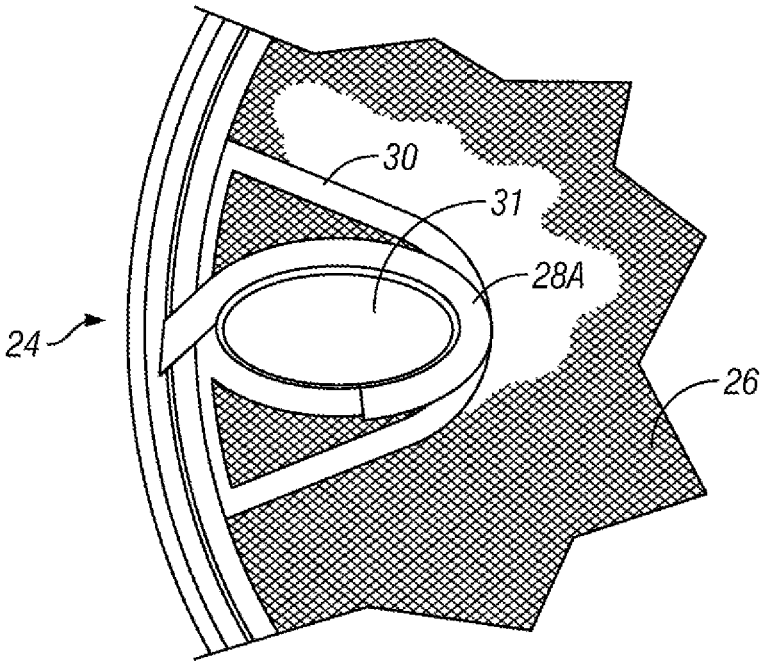
FIG. 7 is a detailed plan view of the combination seal and baffle, mounting ring therefor and the screen of the present separator.

The shape of the baffle 28A may be better understood with reference to FIGS. 6 and 7, which show, respectively, an oblique view of the components shown in cross section in FIG. 4 from above the screen 26, and a view of the unit 28, the screen 26, the opening plate 30 and the tension ring 24. The baffle 28A is generally shaped to collect product particles moving in circular directions around the screen 26 and to deflect them into the opening 31. The baffle 28A can sealingly engage the interior surface of the upper separator frame 12 to prevent particles from travelling past the baffle 28A on the outer circumference of the screen 26.

Figure 8:
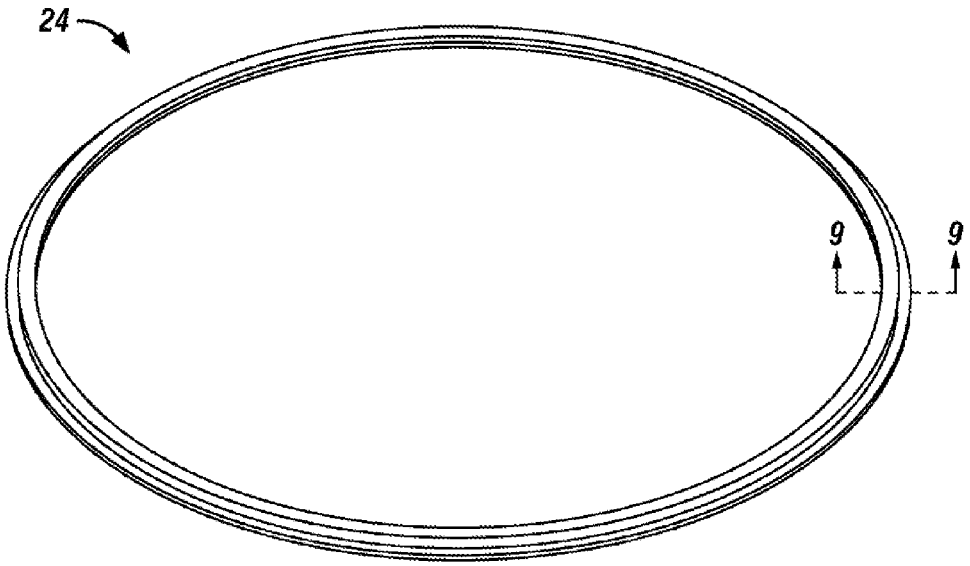
FIG. 8 is an example tension ring for the screen in the present separator.
Figure 9:
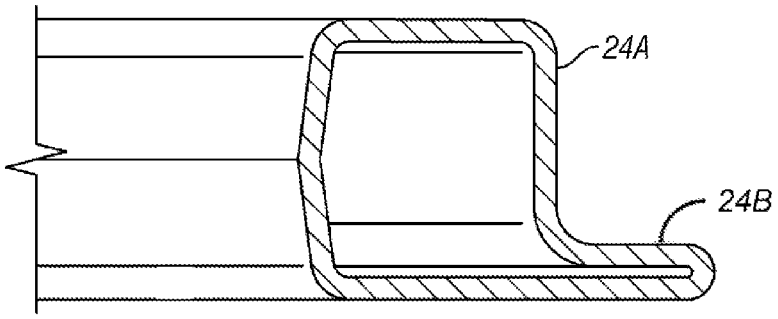
FIG. 9 is a detailed view of the cross section of the present tension ring.
Figure 10:
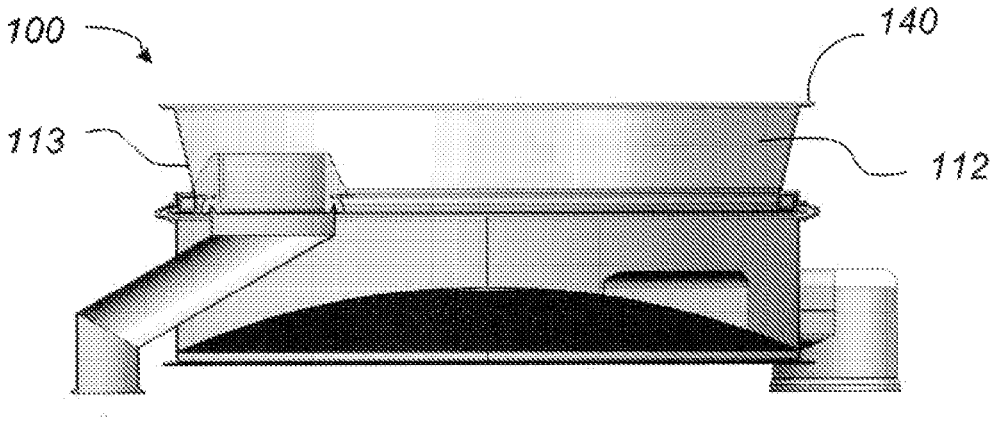
FIG. 10 is a cross sectional view of a separator.
Figure 11:
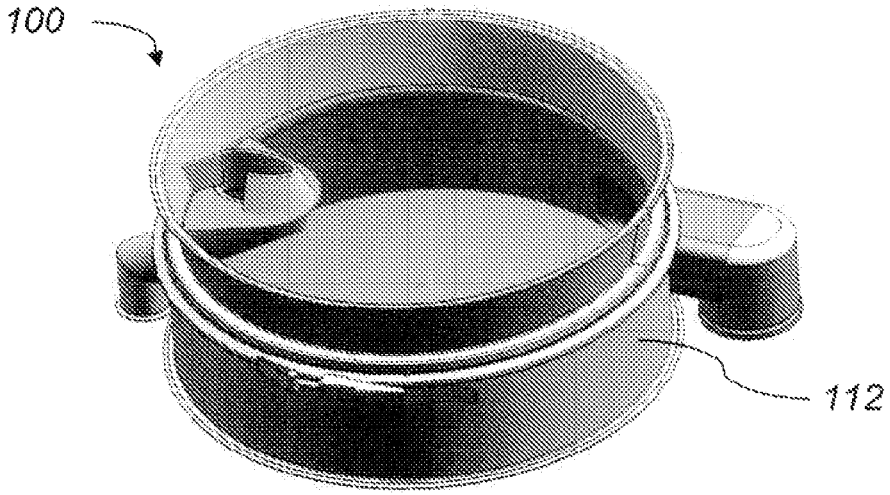
FIG. 11 is an isometric view of the separator shown in FIG. 10.

A typical example of the screen tension ring 24 is shown in oblique view in FIG. 8 and in cross section in FIG. 9. The tension ring 24 may include a flange 24B for engaging the corresponding mounting surface of the upper separator frame (12 in FIG. 3) and a ring section 24A to correctly laterally position the tension ring 24 in the lower separator frame (14 in FIG. 3). Though depicted in FIGS. 8 and 9 in one orientation, in the present example, the tension ring 24 is mounted so that the ring section 24A is oriented downward, as contrasted with the orientation of tension rings used in other separators. By orienting the tension ring 24 as explained herein, any lateral circumferential gap between the tension ring 24 and the separator frame will be directed downward, thus avoiding product particle accumulation.

FIGS. 10-13 show another example of a separator 100 in which an upper separator frame 112 is formed having an upper frame side wall 113 that is tapered. Along an upper edge of the side wall 113, an upper flange 140 may be formed. Upper flange 140 has a profile that matches the corresponding upper flange 40 of the upper separator frame 12, which has a substantially vertical side wall 13 (see FIG. 1). By having the same profile, diameter, and flange size along upper flange 140 as upper flange 40, upper separator frame 112 may interface with the same covers, inlets, and other frames as upper frame 12.

In this example, upper frame side wall 113 tapers inward, or towards the screening surface, from an upper edge from which upper flange 140 extends to a lower edge having a circumference substantially the same as the inner periphery of ring section 24A of tension ring 24. In this example, tension ring 24 is mounted so that the ring section 24A is oriented upward, as is consistent with the orientation of tension rings used in other separators. The tapered side wall 113 directs particles onto the screen. Because the lower edge of the side wall 113 has a circumference that is substantially the same as the inner periphery of the ring section 24A, the accumulation of particles on top of ring section 24A is avoided. Thus, the upper frame side wall 113 tapers such that the particles to be separated are directed towards the screen 26 and do not accumulate on top of the tension ring 24.

Figure 12:
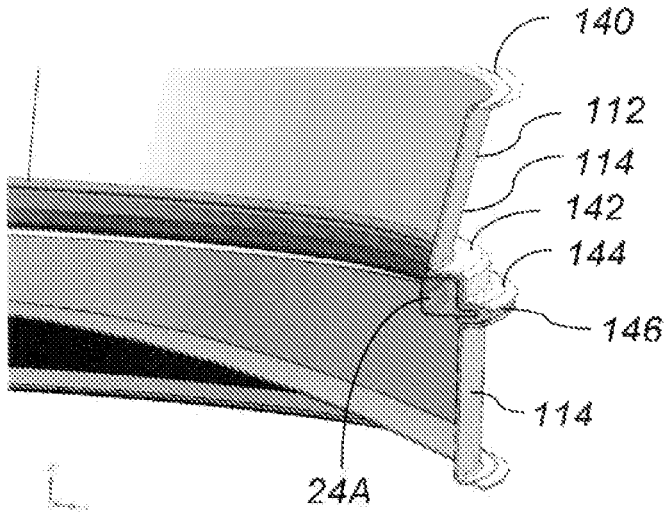
FIG. 12 is a detailed isometric view of components of FIG. 10.
Figure 13:
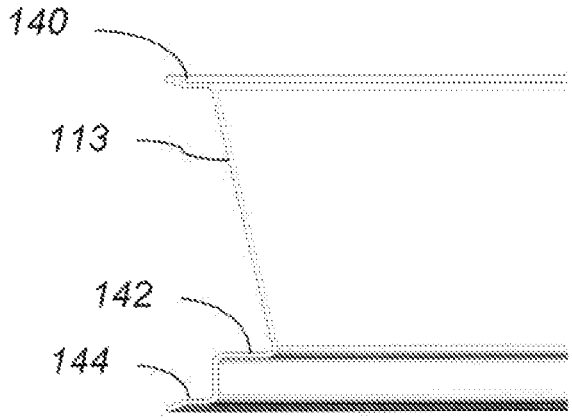
FIG. 13 is a cross sectional view of a frame of the present separator.

A shoulder section 142 may extend outward from the lower edge of the tapered side wall 113 and bend downward around ring section 24A. A lower flange 144 at the bottom of the shoulder section 142 may extend outward to sit atop flange 24B on tension ring 24. As can be seen in FIG. 12, an upper flange on lower separator frame 114 may support the bottom side of flange 24B on tension ring 24. Thus, as previously discussed, the tapered upper frame side wall 113 directs particles to be separated towards screen 26 while the shoulder section 142 overlays ring section 24A to prevent particles from accumulating on top of the tension ring 24. The lower flange 144 on upper separator frame 112 has a profile, diameter, and width/flange size that matches the profile of the lower flange on upper separator frame 12 of the previous example. Thus, the upper separator frame 112 may be substituted on separators that had a substantially vertical side wall 13 (shown in FIG. 1), though, in either case, baffle 28A can sealingly engage the interior surface of the upper separator frame 12 or 112 to prevent particles from travelling past the baffle 28A on the outer circumference of the screen 26.

Figure 14:
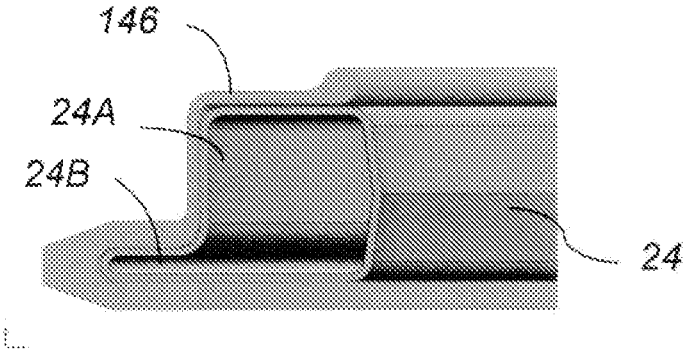
FIG. 14 is a cross sectional view of an example tensioning ring and gasket for a screen for the present separator.
Figure 15:
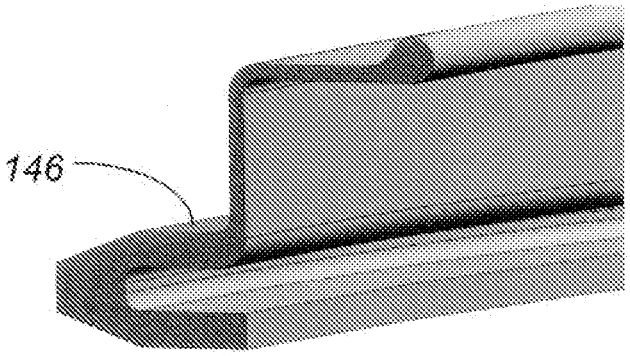
FIG. 15 is an isometric view of an example gasket for the tensioning ring of a screen for the present separator.

Referring to FIGS. 14 and 15, in this example, a gasket 146 may be included around the flange 24B of tension ring 24 and extend over the top surface of ring section 24A to provide a seal between the upper frame 112, the tension ring 24, and the lower frame 114. The gasket 146 may be made from a resilient material that is resistant to chemicals that may be present in the particles being separated and which may be of appropriate grade for the particles being separated, such as, for example, food or pharmaceutical products, which require specific types of material that come into contact with the particles.

A separator made according to the invention may provide increase operating efficiency, by reducing the amount of product that becomes lodged in interior crevices in the separator, and by reducing the amount of product that avoids size separator. The present separator may also provide increased sanitation.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A particle size separator, comprising:

an upper separator frame;

a lower separator frame;

a screen disposed between the upper separator frame and the lower separator frame;

a large size particle outlet having an inlet disposed below the screen;

a small size particle outlet disposed in the lower separator frame; and a combined baffle and seal unit disposed in an opening in the screen, the unit extending from at least a top surface of the screen and through a bottom surface of the screen such that a seal face of the unit sealingly engages the inlet of the large size particle outlet and wherein the unit includes a baffle configured to constrain movement of particles on an upper surface of the screen into the inlet, the baffle configured to sealingly engage an interior wall of the upper separator frame.

2. The separator of claim 1 further comprising means for imparting motion to the separator frames.

3. The separator of claim 1 further comprising an opening plate disposed in the opening in the screen, the opening plate having an interior surface configured to cooperatively engage the opening in the screen, and wherein the combined baffle and seal unit comprises a feature for sealingly engaging an interior surface of the opening plate.

4. The separator of claim 3 wherein the combined baffle and seal unit sealingly engages an entire circumference of the opening plate.

5. The separator of claim 1 wherein the combined baffle and seal unit is formed as a single component.

6. The separator of claim 1 wherein the combined baffle and seal unit is formed from elastomer.

7. The separator of claim 1 wherein the screen is disposed in a tension ring, the tension ring engaged with the upper and lower separator frames.

8. The separator of claim 7 wherein a flange section of the separator ring is engaged with the upper separator frame and a ring section thereof is engaged with the lower separator frame.

9. The separator of claim 1 wherein the upper separator frame includes an upper frame side wall that is tapered towards the screen at a lower edge.

10. The separator of claim 9 further comprising a gasket providing a seal between the upper separator frame, the tension ring, and the lower separator frame.

11. The particle size separator of claim 7, wherein a flange section of the tension ring engages a shoulder of the upper separator frame and a ring section of the tension ring engages a lower flange of the upper separator frame.

12. A particle size separator, comprising:

an upper separator frame;

a lower separator frame;

a screen disposed between the upper separator frame and the lower separator frame, the screen including an opening proximate a perimeter of the screen;

a large size particle outlet having an inlet disposed below the opening;

a small size particle outlet in fluid communication with the lower separator frame; and an integral baffle and seal unit extending through the opening from the upper separator frame to an upper surface of the inlet of the large size particle outlet in the lower separator frame.

13. The particle size separator of claim 12, wherein a profile of the integral baffle and seal unit includes a reduced diameter portion, the reduced diameter portion located below a baffle portion and above a seal portion of the integral baffle and seal unit.

14. The particle size separator of claim 13, wherein the reduced diameter portion of the integral baffle and seal unit sealingly engages an interior surface of the opening.

15. The particle size separator of claim 12, wherein the lower separator frame includes a lower surface that is substantially dome-shaped.

16. The particle size separator of claim 12, further comprising a second upper separator frame disposed above the upper separator frame.

17. The particle size separator of claim 16, further comprising a second screen disposed between the upper separator frame and second upper separator frame.

* * * * *